US005391134A

United States Patent [19]

Heatwole

[11] Patent Number: 5,391,134

[45] Date of Patent: Feb. 21, 1995

[54] EXERCISING AND/OR AMUSEMENT DEVICE

[76] Inventor: Richard L. Heatwole, 1285 Grange Hall Rd., Corydon, Ind. 47112

[21] Appl. No.: 217,337

[22] Filed: Mar. 24, 1994

Related U.S. Application Data

[63] Continuation-in-part of Ser. No. 81,457, Jun. 22, 1993, Pat. No. 5,320,593.

[51] Int. Cl.[6] ..... A63B 23/04

[52] U.S. Cl. ..... 482/146; 482/75; 482/123

[58] Field of Search ..... 482/146, 75, 70, 79, 482/80, 147, 148, 51, 123, 129

[56] References Cited

U.S. PATENT DOCUMENTS

| | | | |
|---|---|---|---|
| D. 193,010 | 6/1962 | Krauss | D34/5 |
| D. 281,343 | 11/1985 | Krive | D21/192 |
| 478,166 | 7/1892 | Madsen . | |
| 1,509,793 | 9/1924 | Thompson . | |
| 1,671,096 | 5/1928 | Anderson . | |
| 1,861,661 | 7/1929 | Huerlin . | |
| 1,911,390 | 5/1933 | Pullman . | |
| 2,206,902 | 7/1940 | Kost | 128/25 |
| 2,714,007 | 7/1955 | Jordan | 272/57 |
| 3,207,510 | 9/1965 | Gibson | 272/57 |
| 3,416,792 | 12/1968 | Morgan et al. | 272/60 |
| 3,511,500 | 5/1970 | Dunn | 272/79 |
| 3,531,110 | 9/1970 | Marchu | 272/57 |
| 3,582,066 | 6/1971 | Keryluk | 272/57 |
| 3,612,519 | 10/1971 | Larson | 272/57 A |
| 3,638,940 | 2/1972 | Mehaulic | 272/83 R |
| 3,683,896 | 8/1972 | Peplin . | |
| 3,785,642 | 1/1974 | Sterlicchi | 272/70 |
| 3,929,329 | 12/1975 | Rivera | 272/57 D |
| 3,984,100 | 10/1976 | Firster | 272/96 |
| 4,101,136 | 7/1978 | Corll | 272/97 |
| 4,111,416 | 9/1978 | Jinotti | 272/96 |
| 4,186,920 | 2/1980 | Fiore et al. | 272/96 |
| 4,199,137 | 4/1980 | Giguere | 272/96 |
| 4,200,282 | 4/1980 | Agyagos | 272/146 |
| 4,279,415 | 7/1981 | Katz | 272/70 |
| 4,285,516 | 8/1981 | Heatwole | 272/146 |
| 4,376,532 | 3/1983 | Hunstad | 272/97 |
| 4,530,498 | 7/1985 | Heathole | 482/146 |
| 4,603,851 | 8/1986 | Russell | 272/96 |
| 4,613,130 | 9/1986 | Watson | 272/135 |

(List continued on next page.)

FOREIGN PATENT DOCUMENTS

| | | |
|---|---|---|
| 1372342 | 10/1974 | United Kingdom . |
| 2084029 | 9/1981 | United Kingdom . |
| 1222288A | 4/1986 | U.S.S.R. . |

*Primary Examiner*—Stephen R. Crow

*Attorney, Agent, or Firm*—Seidel, Gonda, Lavorgna & Monaco

[57] ABSTRACT

An exercising and/or amusement device operably by the hands and feet of the user has first and second platforms rigidly spaced from each other adapted to receive one of the feet of the user. A ground engaging element is below and associated with each platform and has a bottom surface for selectively engaging the ground surface. A pivotable joint connects the platform and its associated ground engaging element. The connector has a curved surface on the platform spaced from the pad and a curved surface on the ground engaging element spaced from the bottom surface. The curved surface of the platform has an opening and the curved surface of the ground engaging element each having an opening therethrough. A bolt extends from the curved surface of the ground engaging element and through the opening in the curved surface of the platform for controlling relative movement between the curved surfaces. A compression spring urges the curved surface of the ground engaging element into engagement with the curved surface of the platform and for biasing the ground engaging element towards a center position relative to the platform. An upper body exerciser is releasable secured to the platforms and adapted to accommodate the hand of the person. The upper body exercise attachment is a pair of attachments. Each attachment having a lower end for securing to one of the platforms and an upper end adapted to accommodate the upper limbs of the user.

20 Claims, 3 Drawing Sheets

U.S. PATENT DOCUMENTS

| | | | |
|---|---|---|---|
| 4,629,181 | 12/1986 | Krive | 272/97 |
| 4,669,722 | 6/1987 | Rangaswamy | 272/96 |
| 4,700,947 | 10/1987 | Heatwole | 272/146 |
| 4,705,028 | 11/1987 | Melby | 128/25 B |
| 4,739,986 | 4/1988 | Kucharik et al. | 482/146 |
| 4,892,305 | 1/1990 | Lynch | 482/146 |
| 4,900,012 | 2/1990 | Fu | 272/65 |
| 4,966,364 | 10/1990 | Eggenberger | 272/111 |
| 5,035,421 | 7/1991 | Scheller | 272/96 |
| 5,062,629 | 11/1991 | Vaughan | 272/97 |
| 5,176,598 | 1/1993 | Gardner | 482/79 |
| 5,320,593 | 6/1994 | Heatwole | 482/146 |

18'
12'
148
144
142
190
176
192
184
188

172
174
182
180
178
10"

EXERCISING AND/OR AMUSEMENT DEVICE

This is a continuation in part application of Application Ser. No. 081,457, filed on Jun. 22, 1993, now U.S. Pat. No. 5,320,593.

FIELD OF THE INVENTION

This invention relates to an exerciser or a walking toy and more particularly to an exercise device having a ground engaging element with a bottom surface for engaging the ground surface, a compression spring and bolt for retaining a curved surface of the ground engaging element in engagement with a platform and centering the engaging element relative to the platform and a removable upper body exercising attachment lot working the upper body.

BACKGROUND OF THE INVENTION

The present invention is directed,to improvements over my earlier U.S. application Ser. No. 08/081,457 now U.S. Pat. No. 5,320,593 entitled "AMUSEMENT AND/OR EXERCISING DEVICE." The present invention improves the devices disclosed in the earlier application by including upper body exercising attachments and by modifying the compression spring.

SUMMARY OF THE INVENTION

The present invention is directed to an exercising and/or amusement device for working the upper and lower body of a user. The device has first and second platforms rigidly spaced from each other adapted to receive one of the feet of the person. A ground engaging element is below and associated with each platform and has a bottom surface for engaging the ground surface. A pivotable joint connects the platform and its associated element. The connector has a curved surface on the platform spaced from the pad and a curved surface on the ground engaging element spaced from the bottom surface. The curved surface of the platform has an opening and the curved surface of the ground engaging element having an opening. A bolt extends from the curved surface of the ground engaging element and through the opening in the curved surface of the platform for controlling relative movement between the curved surfaces. A compression spring urges the curved surface of the ground engaging element into engagement with the curved surface of the platform and for biasing the ground engaging element towards a center position relative to the platform. An upper body exerciser is releasably attached to the platforms and adapted to work the upper body of the user.

One object, feature and advantage resides in the provision of a tapered compression spring carried by the platform for urging the curved surface of the ground engaging element into engagement with the curved surface of the platform and for biasing the ground engaging element towards a center position relative to the platform.

Another object, feature and advantage resides in the upper body exerciser being a pair of separate attachments, each attachment having a lower end for releasably securing to one of the platforms and an upper end adapted to accommodate a hand of the user. In a preferred embodiment, each of the upper body exerciser has a resilient spring intermediate the lower end and the upper end.

Further objects, features and advantages of the present invention will become more apparent to those skilled in the art as the nature of the invention is better understood from the accompanying drawings and detailed description.

DESCRIPTION OF THE DRAWINGS

For the purpose of illustrating the invention, there are shown in the drawings forms which are presently preferred; it being understood, however, that this invention is not limited to the precise arrangements and instrumentalities shown.

DESCRIPTION OF THE INVENTION

Figure 1:
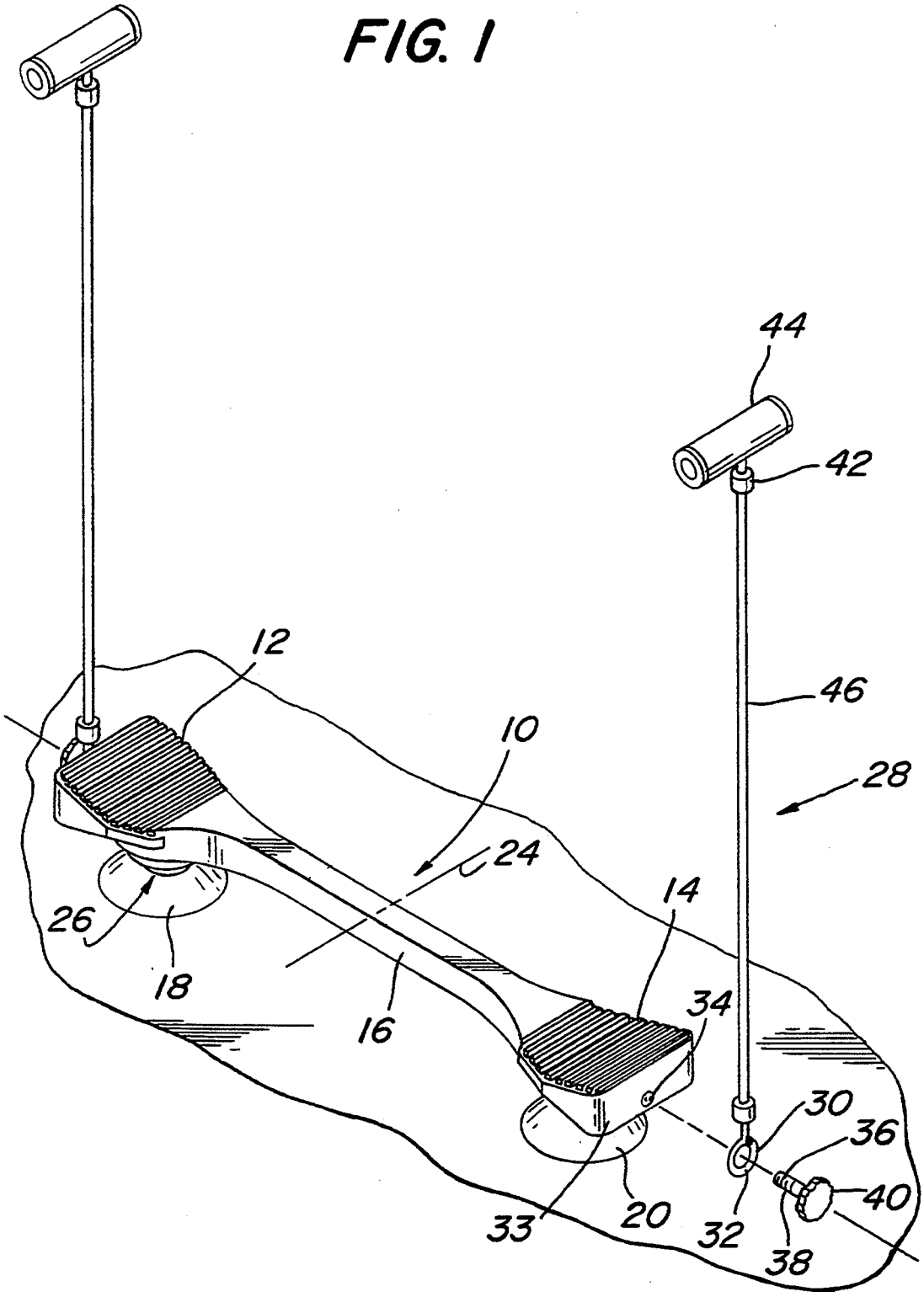
FIG. 1 is a perspective view of a device in accordance with the present invention.

Referring to the drawings in detail, wherein like numerals indicate like elements and where primes (') indicate counterparts of such like elements, there is illustrated a device in accordance with the present invention designated generally as 10.

Referring to FIG. 1, the device 10 includes a pair of platforms designated 12 and 14 to receive a person's feet. The platforms 12 and 14 are rigidly connected together by way of a cross member 16. The platforms 12 and 14 and the cross member 16 are preferably formed integral in one piece.

Each platform 12 and 14 has an associated ground engaging element 18 and 20 respectively for engaging the ground surface. The ground engaging elements 18 and 20 are connected to the platforms 12 and 14 by a pivot joint 26 that allows arcuate motion of the element relative to the respective platform along the longitudinal direction (the longitudinal direction being defined by an axis 22 extending along an imaginary line through both platforms 12 and 14), while limiting relative motion in the transverse direction (the transverse direction being defined by an axis 24 that extends through the cross member 16 and is perpendicular to the longitudinal axis 22).

Each of the platforms 12 and 14 has a side wall 33, only the side wall of platform 14 being visible in the drawings. Each side wall includes a threaded hole 34. A bolt 36 has a threaded shaft 38 received by the threaded hole 34. The bolt 36 has a knurled knob 40 for turning the threaded shaft 38 to secure the bolt 36 to the platforms 12 and 14.

The device 10 includes a pair of upper body exercising attachments 28. Each of the upper body exercising attachments 28 has a lower end 30 having an eyelet 32. The threaded shaft 38 is inserted through the eyelet 32 of the upper body exercising attachment 28 and threaded into hole 34 to secure the upper body exercising attachment 28 to the platforms 12 and 14. The upper body exercising attachment 28 has at an upper end 42 a handle 44 adapted for receiving a person's hand. The upper body exercising attachment 28 has a resilient cord 46 extending between the eyelet 32 and the handle 44. The resilient cord 46 may, for example, be a "bungee cord," and creates a variable resistance to strengthen and tone the shoulder muscle area.

The joint 26 between the elements and the platforms are identical for each platform 12 and 14. Hence, only the platform 12, the element 18 and the joint 26 between element 18 and the associated platform 12 will be described in reference to FIG. 2.

Figure 2:
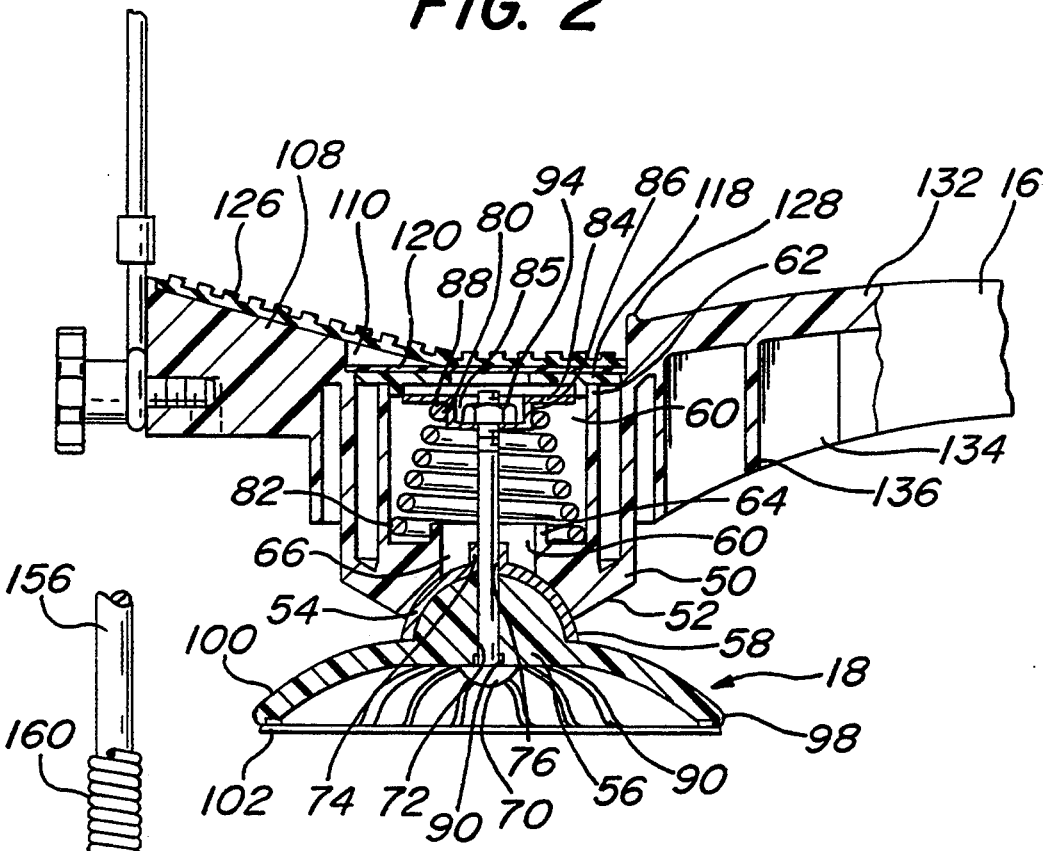
FIG. 2 is a sectional view taken along the line 2—2 in FIG. 1.

Referring to FIG. 2, the platform 12 has a cylindrical portion 50 with a frusto-conical tapered bottom 52 having a partial spherical concave surface 54 portion of the connection means 26. In addition, referring to FIG. 3, the ground engaging element 18 has a hemispherical convex surface 56 covered by a hemispherical convex shell 58 of high wear resistance material such as DELRIN® which is received in the partial spherical concave surface 54.

Located above the partial spherical concave surface 54 of the platform 12 within the cylindrical portion 50 is a bore 60 defined by a cylindrical inner wall 62. An elongated slot 66 extends upward from the apex of the partial spherical concave surface 54 through an annular boss 64 located at the bottom of the bore 60. The major axis of the elongated slot 66 runs in the longitudinal direction, toward and away from the cross member 16 and the other platform 14.

A carriage bolt 70 extends through a hole 72 in the element 18 and a collar 74 defining a hole 76 in the convex shell 58. The bolt 70 extends through the elongated slot 66 into the bore 60 with the collar 74 engaging the side walls of the slot 66. The collar 74 both reduces the stress concentration on the shell 58 and is a bearing surface between the bolt 70 and the walls of the slots 66.

A tapered compression spring 80 is received by the bore 60 and is concentric with the bolt 70. A lower edge 82 of the compression spring 80 engages the cylindrical inner wall 62 of the cylindrical portion 50. A washer 84 is received by the bolt 70 and has a recessed center portion 85. The recessed portion 85 defines a shoulder 86 which receives an upper edge 88 of the compression spring 80 to position the compression spring 80 relative to the bolt 70. A fastener 94 received by the bolt 70 and located in the recessed center portion 85 of the washer 84 retains the washer 84 in engagement with the upper edge 88 of the spring 80, compressing it. The fastener 94 is located lower than the upper edge 88 of the compression spring 80. Therefore, the compression spring 80 may extend further up in the bore 60. In addition, the tapered compression spring 80 results in quieter movement of the spring 80 than a conventional helical compression spring since the coils do not engage each other.

The compression spring 80 maintains the convex shell 58 in engagement with the concave surface 54 of the platform 12 by pulling the bolt 70 upward. In addition, the compression spring 80 biases the ground engaging element 18 to a center position, where the bolt 70 is located in the center of the slot 66. The carriage bolt 70 has a square shoulder 90 in proximity to a head which is received by a similarly shaped opening in the ground engaging element 18 so that the bolt 70 does not rotate relative to the element 18.

Referring to FIG. 2, the ground engaging element 18 has a ribbed dome-shaped foot portion 96 which is shaped such that only an outer edge 98 of the bottom surface engages the ground surface. The edge 98 has a circumferential groove 100 for receiving a friction ring 102.

Each of the platforms 12 and 14 has a top wall 108. The cylindrical portion 50 is connected to the top wall 108. A square opening, a shoulder, 110 in the top wall 108 grants access to the bore 60 which receives the compression spring 80, the washer 84 and the fastener 94. The top of the inner wall 62 is located slightly below the shoulder 100.

An annular cap 118 with an access hole is adhesively mounted on top of the inner wall 62 upon assembly. A square cover 120 is received by the square shoulder 110 and has four split tabs, not shown, received by holes in the inner core 50. An anti-slip cover 126 overlies the cover 120 and the top wall 108 defining an upper surface to receive the person's foot. A ridge 128 more clearly defines a shoulder 130 at the cross member 16—platform 12 interface and helps locate the person's foot as described below. The top wall 108 arches upward at its outer periphery and connects to the depending peripheral side wall 33 having the threaded hole 34.

The cross member 16 includes a top wall 132 and side walls 134. Crisscross ribbing 136 in the cross member 16 provides substantial stability and resistance to twisting.

The device 10 is preferably molded from an A.B.S. plastic such as the material sold under the trade name CYCOLAC TM. The shell 58 is made from polymeric plastic material such as DELRIN® to create a beating surface between the concave surface 54 of the platform 12 and the hemispherical convex surface 56 of the ground engaging element 18, which are like materials. The anti-slip cover 126 and the friction ring 102 are preferably made from neoprene rubber having a durometer of 80 to 90. Other equivalent polymeric plastics may be used.

In Operation

A person wishing to use the device initially grasps the handles 44 of the upper body exercise attachments 28 and then mounts the device 10, with the feet located on the anti-slip cover 126 directly above the compression spring 80 and washer 84. The shoulder 130 helps ensure that the feet are not located too far inward by creating a ledge to butt the foot against and ensures correct foot placement so the user does not have to look down at the exercise device as she/he mounts or dismounts the device 10. The user shifts her/his feet outward to the outer periphery of the anti-slip cover 126 in proximity to the side wall 112. The user shifts her/his weight to one leg and associated platform, therein the ground engaging element associated with the opposite leg lifts to slightly elevate it off the ground surface, with the ground engaging element, associated with the weight, shifting relative to the platform. The slot 66 in the platform 12 limits the movement of the ground engaging element to motion in the longitudinal direction and thereby preventing forward and backward rocking, motion in the transverse direction, of the exercising device 10. The bolt 70 moves beyond the center and towards the other platform 14 in instances where the ground engaging element 18 is engaging an elevated surface such as a curb.

The platform is pivoted relative to the ground engaging element in contact with the ground surface to allow movement and then the return to the ground. The process is repeated with the opposite foot. At any time, the platform may be rotated 360° with respect to one of the ground engaging elements with the bolt 70 rotating relative to the platform 14.

The dome-shaped surface of the ground engaging element 18 in conjunction with the friction ring 102 allows for a more secure engagement whereby if the surface is not perfectly flat or has small objects (i.e. pebbles, gravel or dirt), the ground engaging element 18 will still be steady. When the ground engaging element 18 is raised from the ground surface, the compression spring 80 will rotate the ground engaging element 18 back to the center position.

The user, while moving the feet in the manner described above, holds the handles 44 with the hands. The user can initially start moving the hands in a walking motion such that the foot moves with the opposite hand, as when walking normally. Initially, the resilient cord 46 is held just barely taut and the hand holding the handles 44 moves only slightly. As the user becomes more accustomed to the motion, she/he can move the hands in a larger swinging motion forward and upward, thus creating more resistance on the resilient cord 46 and toning the upper body.

It is recognized that other exercises may be done with the upper body exercise attachment 28, and that the arm swing is just one such exercise. One example of another exercise is curls, wherein the user does not move the feet, but rather simply bends the arm upward from the elbow.

Figure 3:
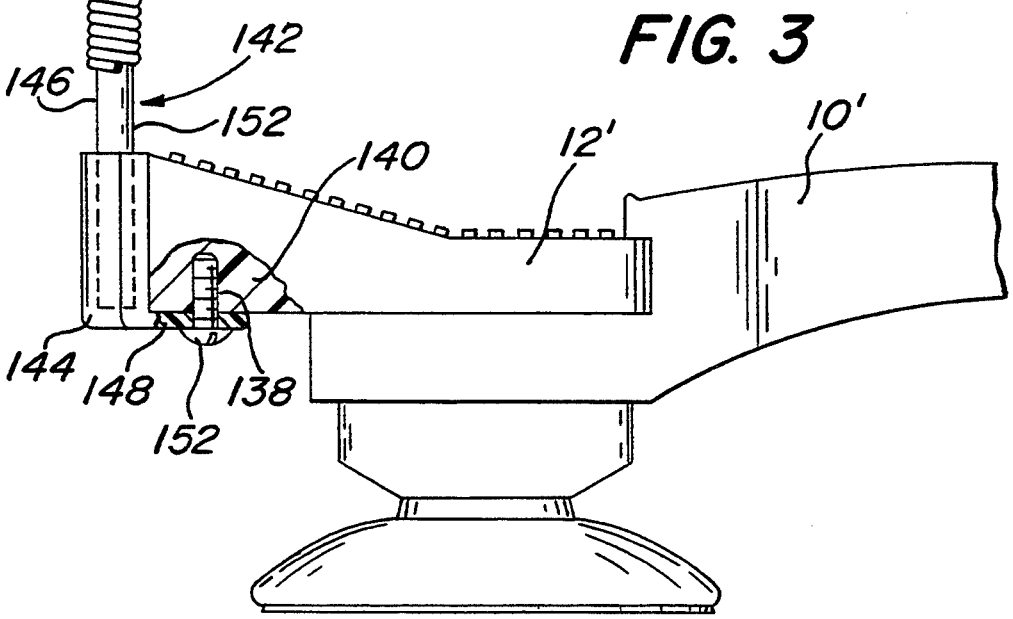
FIG. 3 is a side elevation view of a portion of the exercise device showing an alternative embodiment of the invention. A portion of one of the platforms is broken away showing the threaded hole.
Figures 4, 5:
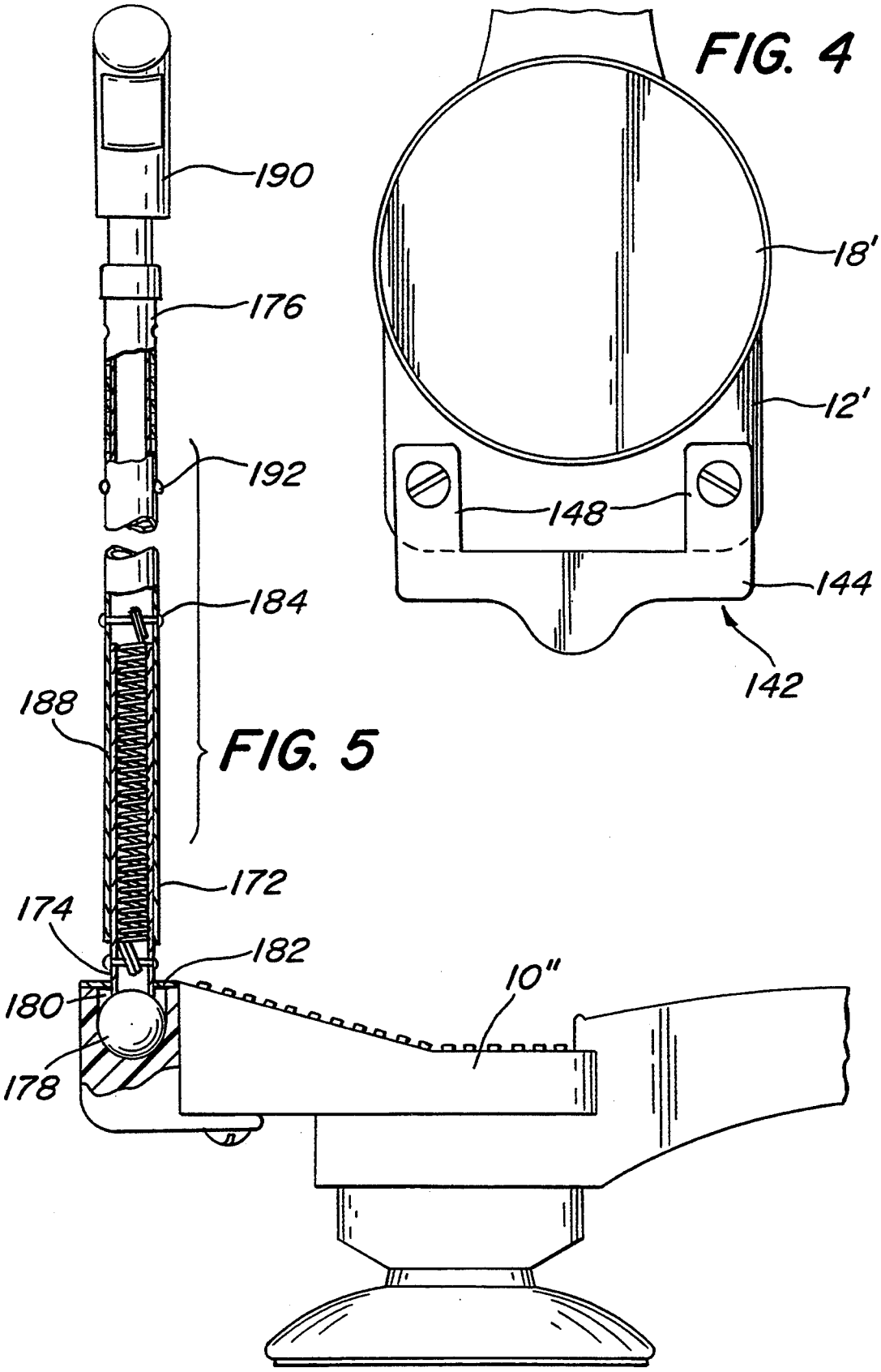
FIG. 4 is a bottom view of one of the platforms of the exercise device showing the tabs of the base portion of the upper body exercise attachment.
FIG. 5 is a side elevation view of a portion of the exercise device showing another alternative embodiment of the upper body exercise attachment, with portions broken away showing the compression spring.

FIGS. 3 and 4 show an alternate embodiment where like numbers equal like elements. The platform 12' is similar to the preferred embodiment already described. The platform 12' has a pair of threaded holes 138 extending upward from a lower portion 140 of platform 12'. The device 10' has an alternate upper body exercise attachment 142. The upper body exercise attachment 142 has a base portion 144 and an exercise pole 146. The base portion 144 has a pair of tabs 148 for aligning with the threaded holes 138 of the platforms 12 and 14. The tabs 148 each has a hole 150 that aligns with one of the threaded holes 138 in the platforms 12' and 14'. Screws 152 are inserted through the holes 150 and threaded into the threaded holes 138 of the platforms to secure the base portion 144 of the upper body exercise attachment 142 to the platforms 12' and 14'.

It is recognized that alternate means of securing the upper body attachment 142 to the platforms 12' and 14' are available. For example, the threaded holes 138 could be replaced by smooth bores and the tabs 148 of the base portion 144 each would have a pin to be received by the bores in the platform for alignment. A detent mechanism could be located on the side wall 33' of the platform such that the base portion could snap into place.

The exercise pole 146 has a pair of pole segments 154 and 156. The lower pole segment 154 is received by a bore 158 in the base portion 144 of the upper body exercise attachment 142. The upper pole segment 156 is spaced from the lower pole segment 154 by a coiled spring 160. The user of this embodiment grasps upper end 42 (not shown) of the upper pole segment 156. The coiled spring 160 is of sufficient stiffness that vertical movement of the upper pole segment 156 relative to the lower pole segment 154 is difficult, while at the same time side to side movement is possible. Thus, a rocking motion can be achieved.

In operation, the user grasps the upper end, not shown, of the upper arm exercise attachment 142 and mounts the platforms 12' and 14'. The movement of the platforms 12' and 14' would be similar to that described in the preferred embodiment and the upper pole segment 156 would be rocked, giving the user the feel of a skiing motion.

FIG. 5 shows another alternative embodiment. The device 10'' has a upper body exercise attachment 164. The upper body exercise attachment 164 has a base portion 166 which mounts similarly to that of the first alternative embodiment having tabs 168 through which screws 170 are attached. The upper body exercise attachment 164 has an exercise pole 172. The exercise pole 172 has a lower pole segment 174 and an upper pole segment 176. The lower pole segment 174 has a ball 178 at its lower end. The base portion 166 has a socket 180 which receives the ball 178. The base portion has a cover 182 to retain the ball 178 in the socket 180. The upper pole segment 176 slideably receives a portion of the lower pole segment 174 such that the movement of the upper pole segment 176 is limited to movement along the axis of the pole segments. Each pole segment 174, 176 has a pin 184 that extends through the pole. The upper body exercise device 164 has a coiled spring 188 extending between the pins 184. Movement of the upper pole segment 176 is limited by the tension of the spring 188. The upper pole segment 176 has a handle portion 190. The handle portion 190 is telescopically received in the upper pole segment 176.

The handle portion 190 has a pair of detent balls 192 which are selectably received by a series of poles in the upper pole segment 176 to adjust the height of the handle 190.

Various modifications of the present invention can be attained. For example, the concave surface 34 and the convex surface 36 could be portions of larger diameter spheres. The elongated slot 46 could be replaced with a large opening therein allowing greater tilting of the platform 12 relative to its ground engaging element. The friction ring 82 could be eliminated and the entire dome-shaped foot portion 76 made out of a rigid high friction material.

The present invention may be embodied in other specific forms without departing from the spirit or essential attributes thereof and, accordingly, reference should be made to the appended claims, rather than to the foregoing specification, as indicating the scope of the invention. It is recognized that an anti-slip material could be molded into the platforms 12 and 14 in place of a separate anti-slip cover 126.

I claim:

1. An exercising and/or amusement device for working the upper and lower body of a user, comprising:

first and second platforms spaced from each other, each platform having an upper surface being adapted to receive one of the feet of the user;

a ground engaging element associated with each platform and having a bottom surface for engaging the ground surface;

a pivotable joint connecting the platform and its associated ground engaging elements comprising a curved surface on the platform spaced from the upper surface and a complimentary curved surface on the ground engaging element spaced from the bottom surface wherein the curved surfaces slideably engage each other, the curved surface of the platform having an opening, a link extending from the curved surface of the ground engaging element and through the opening in the curved surface of the platform for controlling relative movement between the curved surfaces, and bias means for urging the curved surface of the ground engaging element into engagement with the curved surface of the platforms and for biasing the ground engaging element towards a center position relative to the platform; and an upper body exerciser releasably attached to the platforms and adapted to work the upper body of the user.

2. An exercising and/or amusement device as in claim 1 wherein the upper body exerciser comprises a pair of separate attachments, each attachment having a lower end for removably securing it to one of the platforms and an upper end adapted to accommodate a hand of the user.

3. An exercising and/or amusement device as in claim 2 wherein the upper body exerciser has a resilient spring means intermediate the lower end and the upper end.

4. An exercising and/or amusement device as in claim 3 wherein the curved surface of the ground engaging element has an opening therethrough, the link is a bolt extending through said opening and the opening in the curved surface of the platform and has a head located at one end; and the bias means is a compression spring carried by the platform and encircling the bolt.

5. An exercising and/or amusement device as in claim 4 wherein the compression spring is tapered and the spring is secured by a washer having a recessed portion for engaging an end of the spring.

6. An exercising and/or amusement device as in claim 4 wherein the ground engaging element has a dome-shaped bottom surface, the outer edge of which engages the ground surface.

7. An exercising and/or amusement device operably by the feet and hands of a user, comprising:

first and second platforms rigidly spaced from each other, each platform having a pad being adapted to receive one of the feet of the user;

a ground engaging element below and associated with each platform, the ground engaging element having a bottom surface for selectively engaging a ground surface;

a pivotable joint connecting the platform and its associated ground engaging element, comprising a curved surface on the platform spaced from the pad and a curved surface on the ground engaging element spaced from the bottom surface, one of the curved surfaces being a concave curved surface and the other curved surface being a complementary convex curved surface for engaging the concave surface, the curved surface of the platform and the curved surface of the ground engaging element each having an opening therethrough, a link extending through the opening in the curved surface of the ground engaging element and through the opening in the curved surface of the platform for controlling relative movement between the curved surfaces, and bias means for urging the curved surface of the ground engaging element into engagement with the curved surface of the platform and for biasing the ground engaging element towards a center position relative to the platform; and an upper body exerciser releasably attached to the platforms and adapted to accommodate the upper limbs of the user.

8. An exercising and/or amusement device as in claim 7 wherein the upper body exerciser comprises a pair of separate attachments, each attachment having a lower end for securing it to one of the platforms and an upper end adapted to accommodate a hand of the user.

9. An exercising and/or amusement device as in claim 8 wherein the upper body exerciser has a resilient spring means intermediate the lower end and the upper end.

10. An exercising and/or amusement device as in claim 9 wherein the link is a bolt extending through the opening of the curved surface of the ground engaging element and through the opening in the platform and having a head located at one end; and the bias means is a compression spring carried by the platform and encircling the bolt.

11. An exercising and/or amusement device as in claim 10 wherein the ground engaging element has a dome-shaped bottom surface; the outer edge of which engages the ground surface.

12. An exercising and/or amusement device as in claim 8 wherein each of the attachments comprises a resilient cord.

13. An exercising and/or amusement device as in claim 12, wherein the lower end of the cord has an eyelet for engaging a fastener extending from the platform.

14. An exercising and/or amusement device as in claim 13 wherein the fastener comprises is a knurled knob and threaded rod received by a threaded hole in the platform.

15. An exercising and/or amusement device as in claim 8 wherein each of the attachments comprises a pair of rigid pole segments and a resilient portion between the rigid pole segments.

16. An exercising and/or amusement device as in claim 15, wherein the resilient portion is a coiled spring allowing substantial lateral movement and preventing substantial longitudinal movement.

17. An exercising and/or amusement device as in claim 15 wherein the resilient means is a lateral spring allowing reciprocal movement of the rigid pole segments toward and away frown each other.

18. An exercising and/or amusement device as in claim 17 wherein one of the rigid pole segments is slideably received within the other pole segment for limiting motion in a transverse direction.

19. An exercising and/or amusement device as in claim 18 wherein the rigid pole segments are pivotably mounted to the platform.

20. An exercising and/or amusement device as in claim 19 wherein the upper body exercising attach has a base releasably attached to the platform, the base including a socket for receiving a ball on an end of the rigid pole segment.

* * * * *